US005178172A

United States Patent [19]

Morley

[11] Patent Number: 5,178,172

[45] Date of Patent: Jan. 12, 1993

[54] DISHWASHER LID

[75] Inventor: Stuart A. Morley, Rydalmere, Australia

[73] Assignee: McIlwraith Davey Pty Limited, Revesby, Australia

[21] Appl. No.: 792,228

[22] Filed: Nov. 14, 1991

[30] Foreign Application Priority Data

Nov. 15, 1990 [AU] Australia ..... PK3378

[51] Int. Cl.[5] ..... B08B 3/02

[52] U.S. Cl. ..... 134/183; 134/200; 134/201; 134/115 R

[58] Field of Search ..... 134/182, 183, 200, 56 D, 134/57 D, 58 D, 115, 201

[56] References Cited

U.S. PATENT DOCUMENTS

| | | | |
|---|---|---|---|
| 1,439,823 | 12/1922 | Kaufmann | 134/183 X |
| 2,261,988 | 11/1941 | Gaebel | 134/115 |
| 2,632,452 | 3/1953 | Spitzer | 134/115 |
| 2,675,010 | 4/1954 | Hollerith | 134/115 X |
| 2,691,986 | 10/1954 | Kirby | 134/115 X |
| 3,026,628 | 3/1962 | Berger, Sr. et al. | 34/231 |
| 3,876,469 | 4/1975 | Schimke | 134/95 |
| 3,908,681 | 9/1975 | Schimke et al. | 134/94 |
| 3,974,843 | 8/1976 | Aubert | 134/115 X |
| 4,919,162 | 4/1990 | Limby | 134/115 |

FOREIGN PATENT DOCUMENTS

| | | | |
|---|---|---|---|
| 3642568 | 6/1988 | Fed. Rep. of Germany | 134/56 D |
| 2075918 | 10/1971 | France . | |
| 54-52867 | 4/1979 | Japan . | |

*Primary Examiner*—Frankie L. Stinson

*Attorney, Agent, or Firm*—Fitch, Even, Tabin & Flannery

[57] ABSTRACT

A dishwasher lid assembly (1) is disclosed which includes a lid having upper (2) and lower (3) portions. The lid (2,3) is pivotally supported by a hinge shaft (4) above a sink (8). A hinge spring (5) surrounds the shaft (4) and biases the lid (2,3) to an open configuration. A latch can be used to retain the lid (2,3) closed. The shaft (4) and spring (5) are located within a hinge cover (9) below which is an air vent (6) arranged to permit vapor and/or air within the sink (8) to escape, thus preventing a build-up of pressure under the lid (2,3).

14 Claims, 9 Drawing Sheets

DISHWASHER LID

The present invention relates to a dishwasher lid and more particularly, though not exclusively, to a hinged lid applicable for a sink type dishwasher.

In known sink type dishwashers which comprise a tub into which dishes and the like are placed through an upper opening thereof for washing, a lid may be provided.

As the water used in such dishwashers is often quite hot, a build up of pressure within the dishwasher results. Such build up of pressure is clearly undesirable in terms of safety and efficiency for example.

It is an object of the present invention to substantially overcome, or ameliorate these problems through provision of a lid for a sink type dishwasher or like vessel with a venting means to vent air and/or vapour therefrom without allowing passage of liquid therethrough.

In one broad form, the present invention provides a lid assembly for a sink type dishwasher or like vessel, the lid assembly comprising a lid adapted to be fixed by a spring loaded hinge means to a periphery of a sink, and ventilation means adapted to allow fluid communication between the interior of said sink and atmosphere, the ventilation means being provided in a region of said spring loaded hinge means and comprising means to prevent splashing liquid from within the sink passing therethrough.

Generally, the fluid communication only permits the venting of vapour to atmosphere.

Advantageously, said spring loaded hinge means effects a biasing of said lid into an open configuration.

Generally, the lid is provided with a catch which serves to retain said lid in a closed configuration.

Beneficially, the lid, when in an open configuration is adapted to be detached from said region adjacent to said periphery of said sink.

Preferably, the air ventilation means is provided in the form of a channel extending below said spring operated hinge means and provides a tortuous path through which said vapour and/or air can pass while splashed liquid may not.

A preferred embodiment of the present invention will now be described by way of example with reference to the accompanying drawings, wherein.

Figure 1:
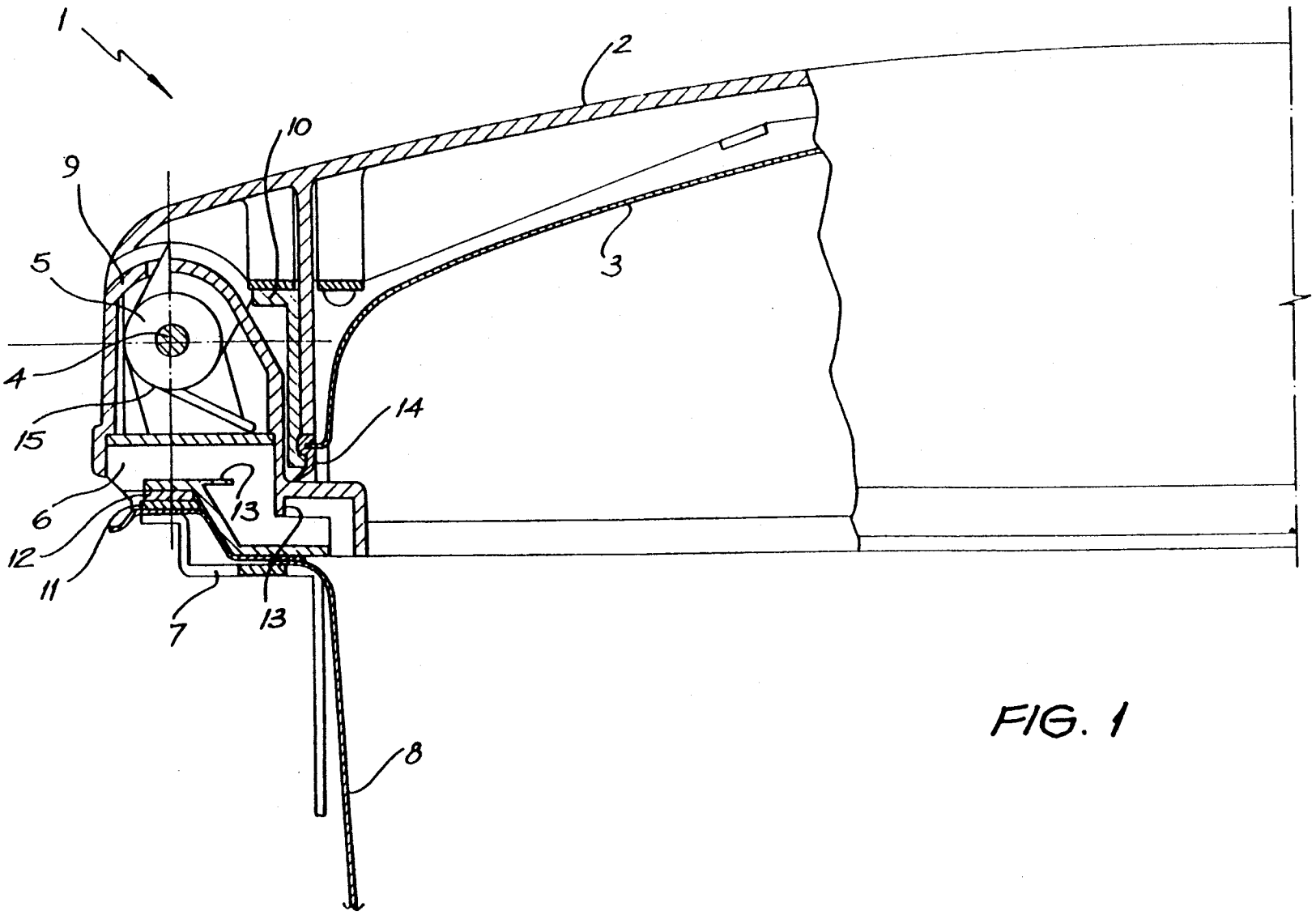
FIG. 1 is a cross-sectional side elevational view of a lid assembly in a closed configuration.

In the accompanying drawings there is schematically depicted a lid assembly 1. As seen in FIG. 1, the assembly 1 has a plastic lid outer 2 and a stainless steel lid inner 3 pivotally supported by a hinge shaft 4 above a sink 8.

Figure 2:
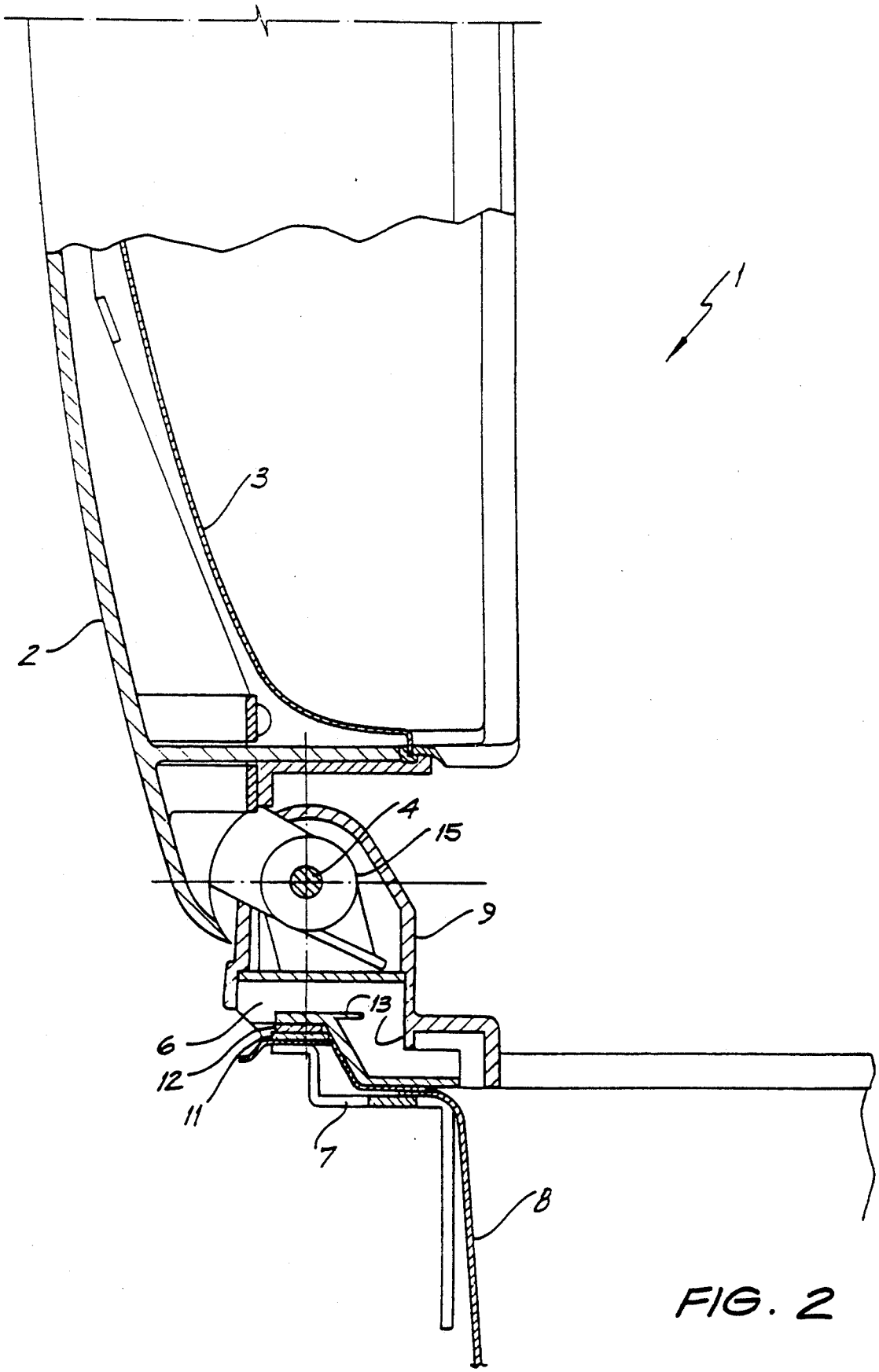
FIG. 2 is a view similar to FIG. 1 of the lid assembly in an open configuration.
Figure 3:
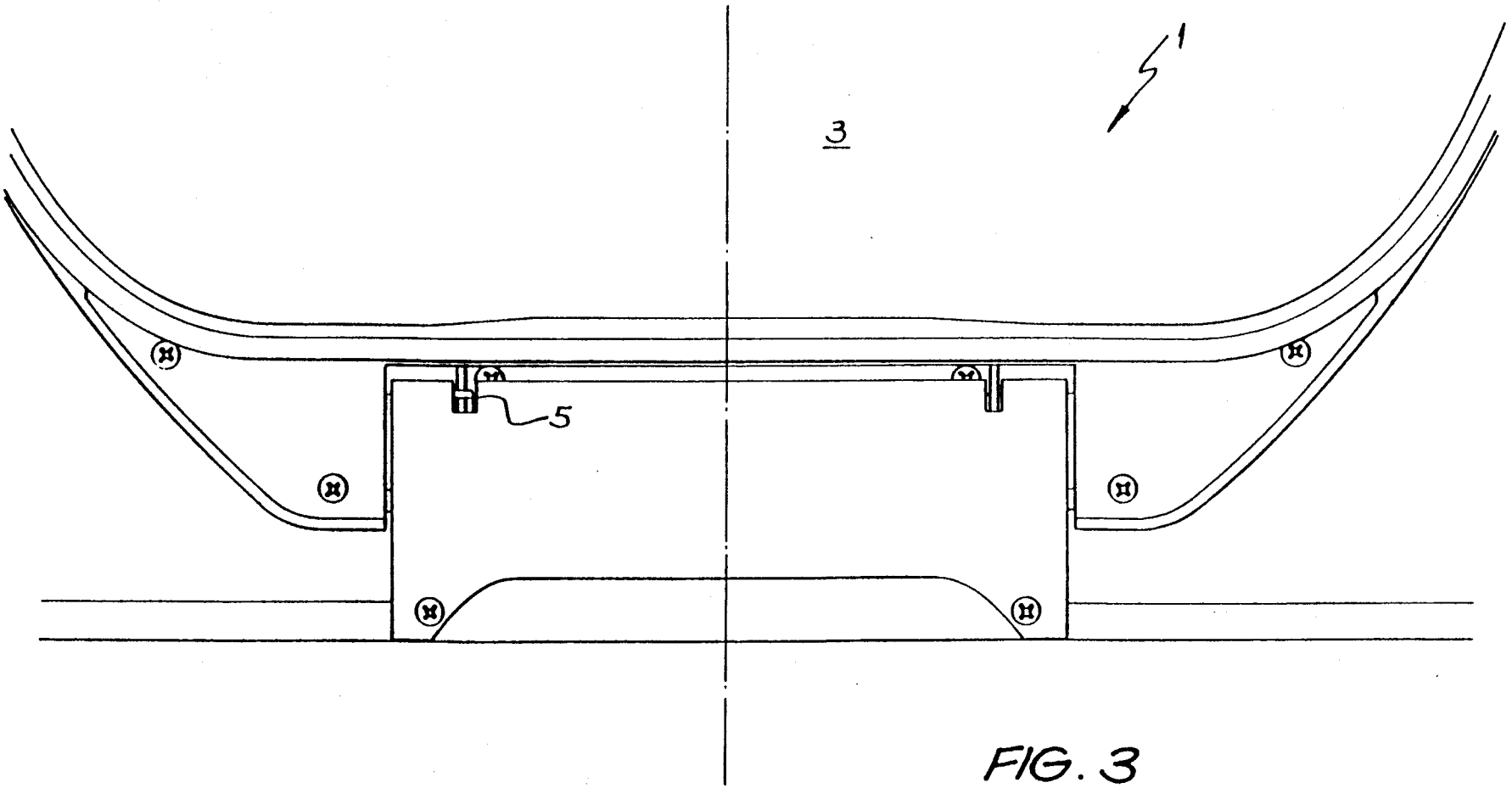
FIG. 3 is a elevational view of the lid assembly in FIG. 2.
Figure 4A:
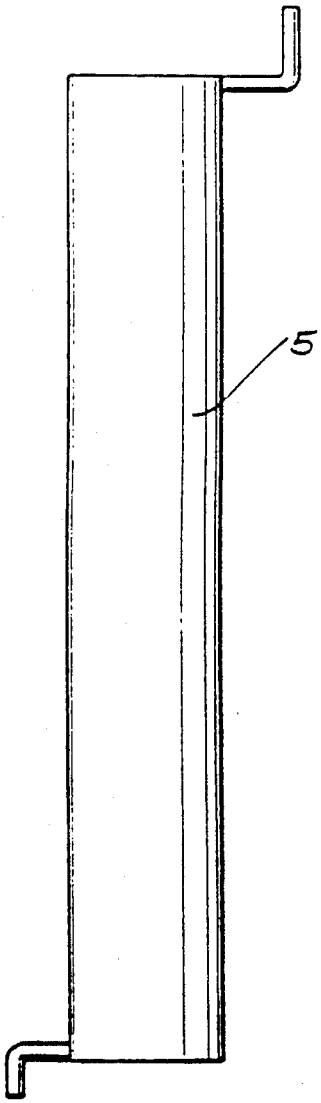
FIGS. 4A and 4B show plan and end elevational views of the hinge spring of FIGS. 1 to 3.
Figure 5A:
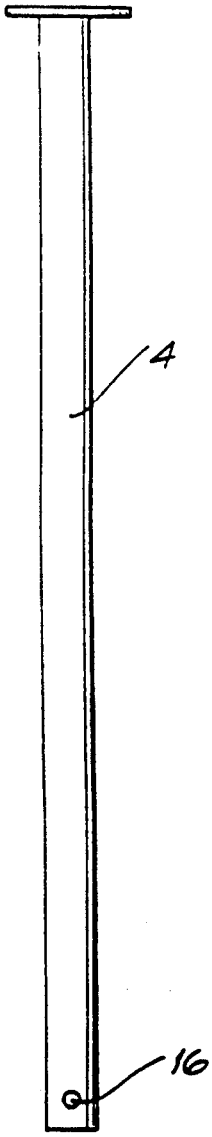
FIGS. 5A and 5B show corresponding view of the hinge shaft.
Figure 4B:
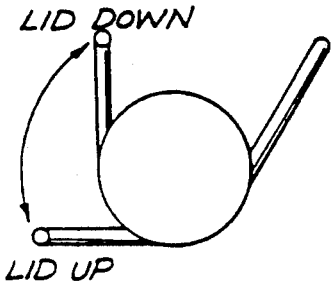
Figure 5B:
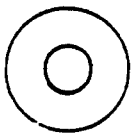

The hinge shaft 4 (better seen in FIGS. 5A and 5B) is surrounded by a hinge spring 5 (FIGS. 4A and 4B) which biases the lid 2, 3 towards an open configuration as depicted in FIG. 2. The hinge shaft 4 and hinge spring 5 are located within a hinge cover 9. Located below the hinge cover 9 (FIG. 10) is an air vent 6 (FIG. 11) through which vapour and/or air from within the sink 8 can escape.

A resilient seal 14 is attached to lid inner 3 by any suitable means such as an interference fit or by an adhesive. The seal 14 is adapted to engage with a lower portion of the hinge cover 9 so as to prevent escape of vapour and/or liquid therepast.

Figure 7A:
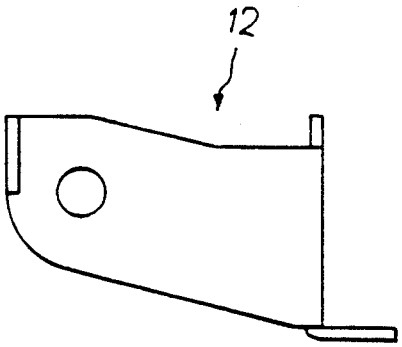
FIGS. 7A, 7B and 7C show end, plan and side elevation views of the hinge bracket.
Figure 7B:
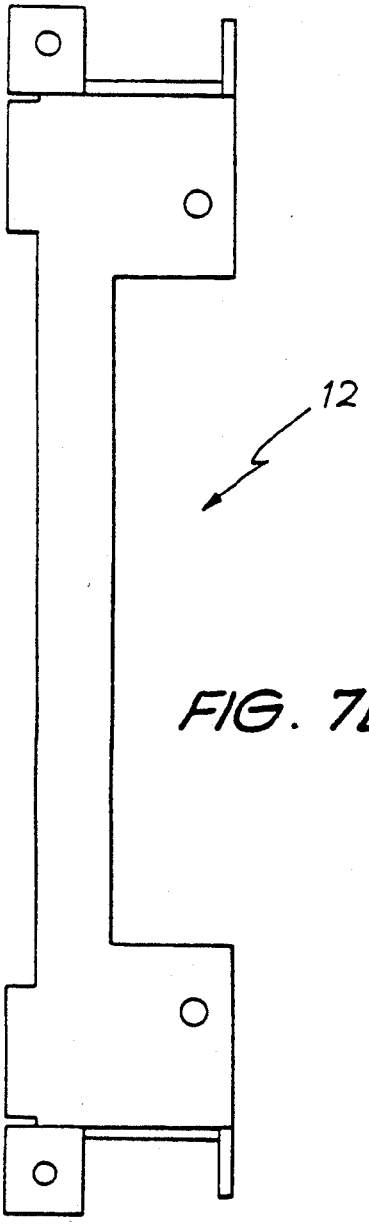
Figure 7C:
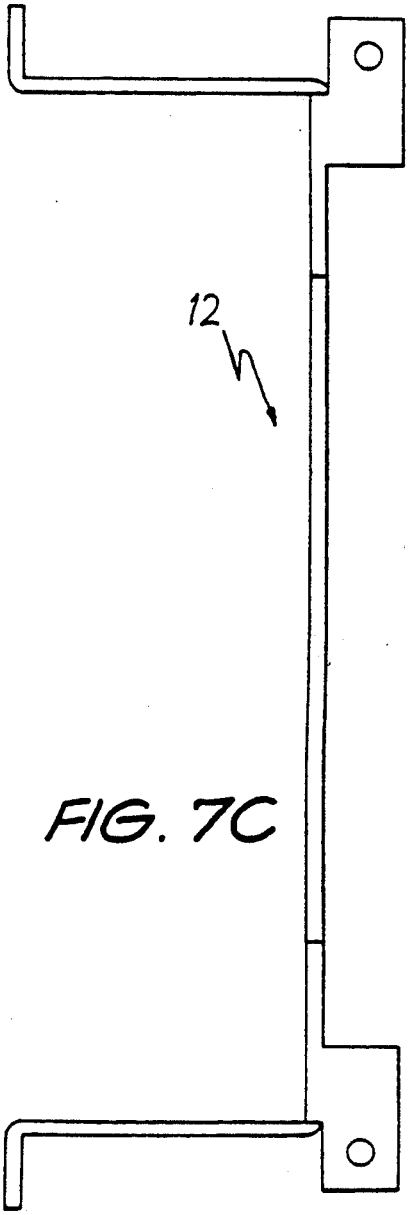
Figure 8A:
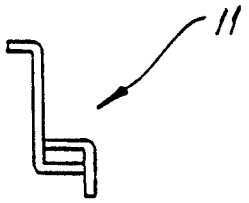
FIGS. 8A, 8B and 8C are corresponding views of the sink bracket.
Figures 8B, 8C:
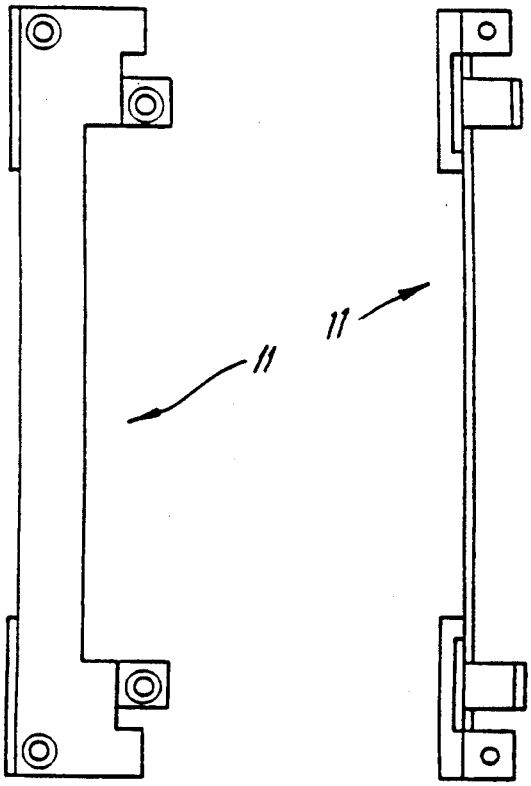
Figure 9A:
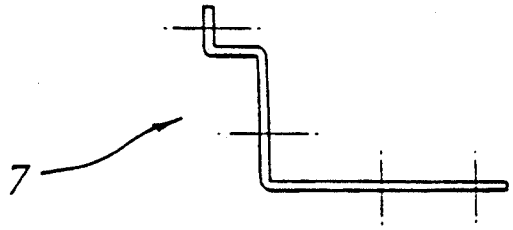
FIGS. 9A, 9B and 9C are corresponding views of the bracket support.
Figure 9B:
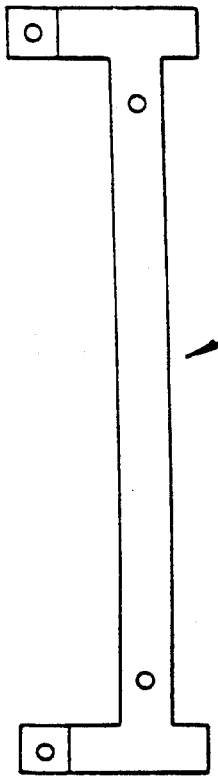
Figure 9C:
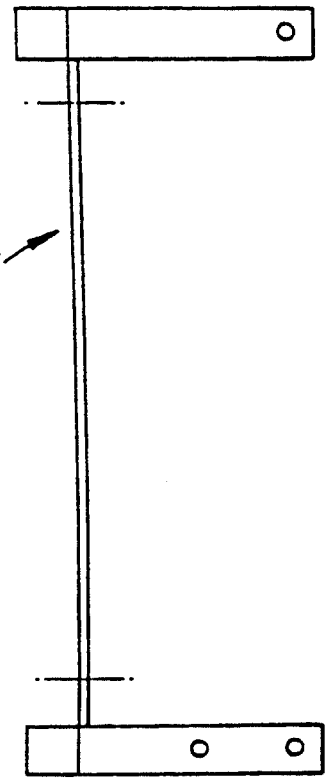
Figure 10A:
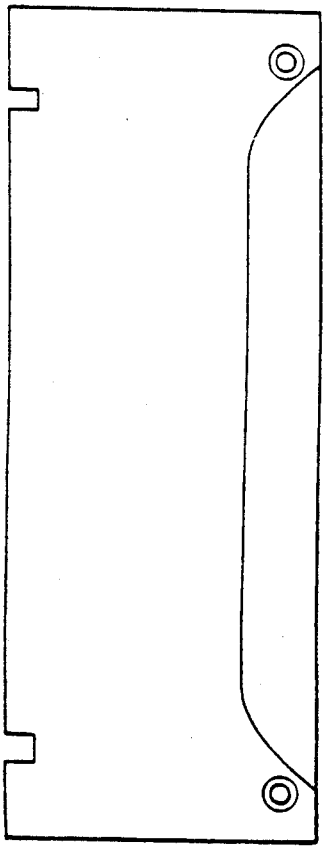
FIGS. 10A, 10B, 10C and 10D show respectively front, bottom, side and sectional views of the hinge cover.
Figure 10B:
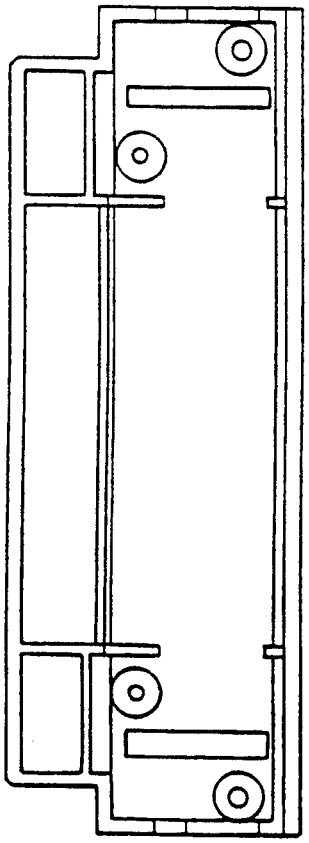
Figure 10C:
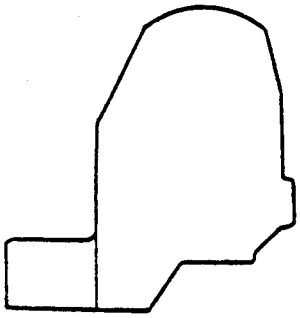
Figure 10D:
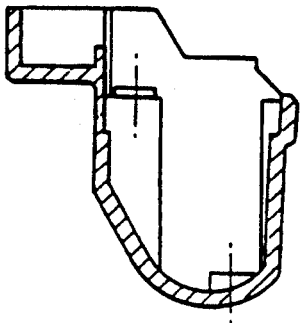
Figure 11A:
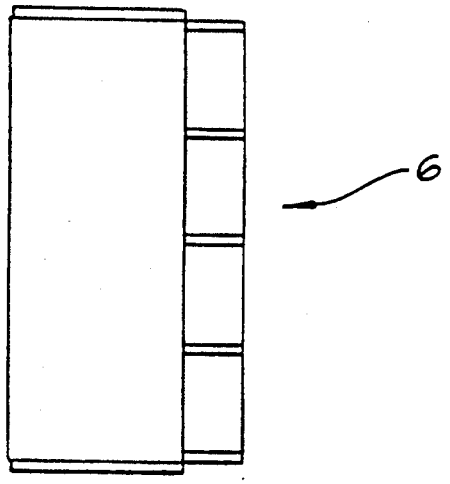
FIGS. 11A, 11B, 11C and 11D show corresponding views of the air vent.
Figure 11B:
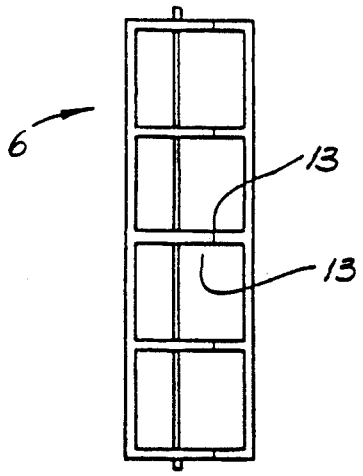
Figure 11C:
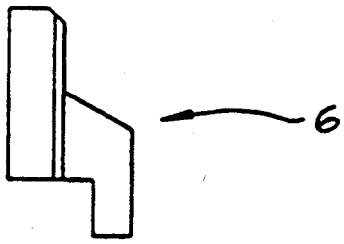
Figure 11D:
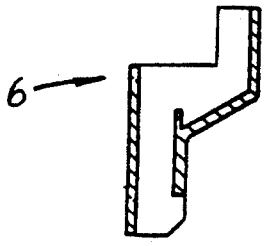

The assembly 1 is mounted to the sink 8 by way of sink bracket 11, hinge bracket 12 and bracket support 7. These various components parts are best depicted in further detail in FIGS. 7, 8 and 9.

Figure 6A:
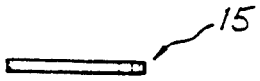
FIGS. 6A and 6B show end and plan elevation views of the hinge spacer.
Figure 6B:
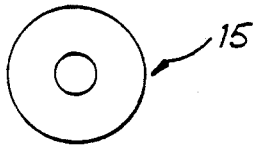

The hinge shaft 4 is insertable through the spring 5 and mounted on the hinge bracket 12 using a hinge spacer 15 (seen in FIGS. 6A and 6B) locatable about the shaft 4 behind pin receiving aperture 16.

When assembled as shown, the lid assembly 1 can be removed from sink 8 by detaching a threaded fastener which penetrates the hinge bracket 12, sink bracket 11, and hinge cover 9. Alternatively, such a threaded fastener can be omitted in a configuration which allows for the lid assembly 1 to be detached from the sink 8 in an open position as depicted in FIG. 2 allowing the hinge parts to be slid apart.

In use, articles to be washed such as dishes and cutlery are placed within the sink 8 in a conventional manner. It should be appreciated that the sink 8 is provided with some form of rotary water dispersion device or dishwasher which directs water generally upwardly from a lower region thereof to wash the dishes. The lid 2, 3 is then closed over the sink 8 and locked down by way of a catch or latch (not shown but known to those in the art). As washing is under way, since the water used in the washing action is typically quite hot, vapour and/or air is allowed to escape from the sink 8 via the vent 6 to atmosphere. The vent 6 is provided with various obstacles 13 which form a honeycomb-like configuration and constitute a tortuous path and accordingly splashed water is not allowed to escape to atmosphere therethrough.

Upon completion of washing, since no build up of pressure within the sink has been allowed, the lid 2, 3 can be opened so as to be biased into a generally vertical orientation by way of the spring 5. In this open configuration, the lid 2, 3 can be removed by detaching screws (not shown) or by sliding in a direction generally parallel to hinge shaft 4.

The foregoing describes only one embodiment of the present invention and modifications, obvious to those skilled in the art can be made thereto without departing from the scope of the present invention. For example, the vent passage 6 can be provided through lid 2, 3 rather than below hinge cover 9.

We claim:

1. A lid assembly for a sink type dishwasher or like vessel, said lid assembly comprising a lid adapted to be fixed to a periphery of a sink by a spring loaded hinge means extending parallel to said periphery, and ventilation means adapted to allow continuous fluid communication between the interior of said sink and atmosphere, the ventilation means including means to prevent splashing liquid within the sink from passing therethrough and the lid, when in an open configuration, being detachable from said periphery of said sink.

2. A lid assembly as claimed in claim 1 wherein said spring loaded hinge means effects a biasing of said lid into an open configuration.

3. A lid assembly as claimed in claim 1 wherein the lid is provided with a catch which serves to retain said lid in a closed configuration.

4. A lid assembly as claimed in claim 1 wherein the ventilation means is provided in the form of a channel extending below said spring operated hinge means and provides a tortuous path through which gaseous matter can pass while splashed liquid may not.

5. A lid assembly as claimed in claim 1 wherein said fluid communication only involves the venting of vapour from within said sink to atmosphere.

6. A lid assembly as claimed in claim 1 wherein said ventilation means is integrally formed in said lid in a region of said spring loaded hinge means.

7. A lid assembly as claimed in claim 1 wherein said spring loaded hinge means is integral with said lid.

8. A lid assembly for a sink type dishwasher or like vessel, said lid assembly comprising a lid adapted to be fixed to a periphery of a sink by a spring loaded hinge means extending parallel thereto, and ventilation means integrally formed in said lid and adapted to allow continuous fluid communication between the interior of said sink and atmosphere, the ventilation means being provided in a region of said spring loaded hinge means and comprising means to prevent splashing liquid within the sink from passing therethrough.

9. A lid assembly for a sink type dishwasher or like vessel, said lid assembly comprising a lid adapted to be fixed to a periphery of a sink by a spring loaded hinge means integrally extending within said lid, and ventilation means adapted to allow continuous communication between the interior of said sink and atmosphere, the ventilation means being provided in a region of said spring loaded hinge means and comprising means to prevent splashing liquid within the sink from passing therethrough.

10. A lid assembly as claimed in claim 8 or 9 wherein said spring loaded hinge means effects a biasing of said lid into an open configuration.

11. A lid assembly as claimed in claim 8 or 9 wherein the lid is provided with a catch which serves to retain said lid in a closed configuration.

12. A lid assembly as claimed in claim 8 or 9 wherein the lid, when in an open configuration, is adapted to be detached from said region adjacent to said periphery of said sink.

13. A lid assembly as claimed in claim 8 or 9 wherein the air ventilation means is in the form of a channel within said lid extending below said spring operated hinges means and provides a tortuous path through which gaseous matter can pass while splashed liquid may not.

14. A lid assembly as claimed in claim 8 or 9 wherein said fluid communication only involves the venting of vapour from within said sink to atmosphere.

* * * * *

UNITED STATES PATENT AND TRADEMARK OFFICE

CERTIFICATE OF CORRECTION

PATENT NO. : 5,178,172

DATED : January 12, 1993

INVENTOR(S) : Stuart Andrew MORLEY

It is certified that error appears in the above-identified patent and that said Letters Patent is hereby corrected as shown below:

Column 1, line 52, change "a" to read --an--.

Column 1, line 53, change the period "." to a semicolon --;--.

Column 1, line 56, change the word "view" to read --views--.

IN THE CLAIMS:

Column 4, line 28 (Claim 13, line 4), change the word "hinges" to read --hinge--.

Signed and Sealed this

Sixteenth Day of November, 1993

*Attest:*

*Attesting Officer*

Bruce Lehman

BRUCE LEHMAN

*Commissioner of Patents and Trademarks*